US006532189B2

(12) United States Patent
Barker

(10) Patent No.: US 6,532,189 B2
(45) Date of Patent: Mar. 11, 2003

(54) CURVED FLOAT FOR MARINE DIVERTORS

(75) Inventor: Glen P. Barker, Friendswood, TX (US)

(73) Assignee: Westerngeco L.L.C., Houston, TX (US)

( * ) Notice: Subject to any disclaimer, the term of this patent is extended or adjusted under 35 U.S.C. 154(b) by 31 days.

(21) Appl. No.: 09/726,634

(22) Filed: Nov. 30, 2000

(65) Prior Publication Data

US 2002/0064091 A1 May 30, 2002

(51) Int. Cl.[7] ..... B63B 21/66
(52) U.S. Cl. ..... 367/17; 114/244
(58) Field of Search ..... 367/17, 16, 25, 367/30; 114/244, 245, 253

(56) References Cited

U.S. PATENT DOCUMENTS

| | | | | |
|---|---|---|---|---|
| 3,611,975 A | | 10/1971 | Ashbrook | 114/235 B |
| 3,703,876 A | * | 11/1972 | Michelsen | 114/235 B |
| 3,794,965 A | | 2/1974 | Charske | 340/7 PC |
| 4,033,278 A | * | 7/1977 | Waters | 114/245 |
| 4,252,074 A | | 2/1981 | Blaisdell | 114/245 |
| 4,463,701 A | * | 8/1984 | Pickett et al. | 114/245 |
| 4,484,534 A | | 11/1984 | Thillaye du Boullay | 114/244 |
| 4,549,499 A | | 10/1985 | Huffhines et al. | 114/244 |
| 4,574,723 A | | 3/1986 | Chiles et al. | 114/253 |
| 4,676,183 A | | 6/1987 | Conboy | 114/245 |
| 4,729,333 A | * | 3/1988 | Kirby et al. | 114/244 |
| D297,004 S | | 8/1988 | Henriksen | D12/316 |
| 4,890,568 A | * | 1/1990 | Dolengowski | 114/246 |
| 5,357,892 A | | 10/1994 | Vatne et al. | 114/244 |
| 5,408,947 A | * | 4/1995 | Curto et al. | |
| 5,532,975 A | | 7/1996 | Elholm | 367/16 |

FOREIGN PATENT DOCUMENTS

| | | | |
|---|---|---|---|
| FR | 1020012 | 1/1953 | |
| FR | 1135612 | 5/1957 | |
| WO | WO 98/25162 | 6/1998 | G01V/1/38 |

OTHER PUBLICATIONS

PCT International Search Report dated Apr. 22, 2002 (PCT/US 01/48751).

* cited by examiner

*Primary Examiner*—Edward Lefkowitz
*Assistant Examiner*—Victor J. Taylor
(74) *Attorney, Agent, or Firm*—David S. Figatner; Williams, Morgan & Amerson, P.C.

(57) ABSTRACT

An apparatus for providing buoyancy to a towed marine divertor and for reducing drag acting on the divertor as the equipment is towed through water. A float attached to the divertor has a curved leading end oriented toward the tow direction to reduce water drag acting against the float. The float can be integrated within the divertor or can be attached with wire rope or chains to lower the divertor within the water. The trailing end of the float can be tapered, and vane foils can be attached to the float outboard side.

26 Claims, 1 Drawing Sheet

CURVED FLOAT FOR MARINE DIVERTORS

BACKGROUND OF THE INVENTION

The present invention relates to the field of marine seismic exploration. More particularly, the invention relates to an improved apparatus for improving the efficiency of divertors towed by seismic vessels in water.

Cables are towed through water in marine seismic operations to transport acoustic energy sources, flotation buoys, hydrophones, and other marine seismic equipment through the water. For large seismic vessels, multiple cables are simultaneously towed in a wide swath through the water. Each cable may extend thousands of meters behind the seismic tow vessel, and adjacent cables must be separated to prevent cable entanglement during vessel movement and turning maneuvers.

Marine seismic operations typically survey the geologic formations underlying large geographic areas. Efficient vessel operation encourages large tow arrays with multiple cables and associated seismic equipment. Marine divertors attached to the cable arrays pull exterior cables outwardly from the in-line tow direction as the tow vessel moves through the water. Such divertors, also known as paravanes, maintain relative spacing between adjacent cables in a direction transverse to the in-line tow direction. Such spacing limits cable entanglement and establishes the transverse location between adjacent source and hydrophone arrays.

Conventional divertors are described in U.S. Pat. No. 3,611,975 to Ashbrook (1971) and in U.S. Pat. No. 4,033,278 to Waters (1977). Because conventional divertors require significant tow force during vessel movement, there is a need to improve tow efficiency by increasing fuel savings. Less drag also increases the seismic array tow capacity of each vessel and permits wider arrays to be towed during each vessel pass.

Floats and buoys support cables and other equipment in the water during marine seismic operations. U.S. Pat. No. 4,549,499 to Huffhines et al. (1985) disclosed a float integral with a V-shaped frame. U.S. Pat. No. 4,890,568 to Dolengowski (1990) disclosed a remotely controllable tail buoy. U.S. Pat. No. 4,676,183 to Conboy (1987) and U.S. Pat. No. 5,532,975 to Elholm (1996) disclosed floats for supporting paravanes in water.

Various divertor wings have been tested. Divertor vanes essentially comprise a wing in the water for urging cables outwardly from the in-line tow direction. For example, a divertor attached to a float was disclosed in U.S. Pat. No. 5,357,892 to Vatne et al. (1994), and techniques for anchoring paravanes was disclosed in U.S. Pat. No. 4,574,723 to Chiles et al. (1986). Because divertors function in a substantially vertical plane, divertors require buoyancy to maintain the relative position in a horizontal plane under tow and when the vessel is stopped. Buoyancy has traditionally been provided by surface "torpedo floats" or "rocket floats" attached with wire rope or chains to each divertor. Another float design was disclosed in U.S. Des. Pat. No. D297004 to Henriksen (1988). Such floats are aligned to the direction of water flow and do not add any lift to the suspended vane.

Certain improved divertors integrate floats within a body attached to divertor vanes. One example is illustrated in U.S. Pat. No. 4,484,534 to Thillaye du Boullay (1984), which disclosed hollow caissons having a rounded leading edge and a central rib. Such integrated floats stabilize movement of the divertor vanes and provide additional lift to the vanes under tow, and the total lift-to-drag ratio for conventional vanes and integrated floats is approximately 1.5 to 3.0. Other cable buoyancy systems were disclosed in U.S. Pat. No. 3,794,965 to Charske (1974) and in U.S. Pat. No. 4,252,074 to Blaisdell (1981).

A need exists for an improved divertor which reduces drag in the water while increasing the lift-to-drag ratio. Such divertor should adequately buoy the divertor vanes at rest and should maximize tow efficiency during marine seismic operations.

SUMMARY OF THE INVENTION

The invention provides an apparatus for providing floatation to a marine divertor in water. The apparatus comprises a hollow body attached to the divertor for providing positive buoyancy to the divertor when said divertor is moved through the water, and a curved leading end of the body substantially oriented at an angle facing the direction of the divertor movement through the water.

Another embodiment of the invention describes an apparatus for urging a tow cable transverse to the travel direction of a tow vessel in water. Such embodiment comprises a body attached to the tow cable, a divertor vane attached to the body for urging the body and attached tow cable at an angle transverse to the tow vessel travel direction, and a float having a curved leading end and being attached to the body for providing positive buoyancy to the body when the body is moved through the water.

DESCRIPTION OF THE PREFERRED EMBODIMENTS

Figure 1:
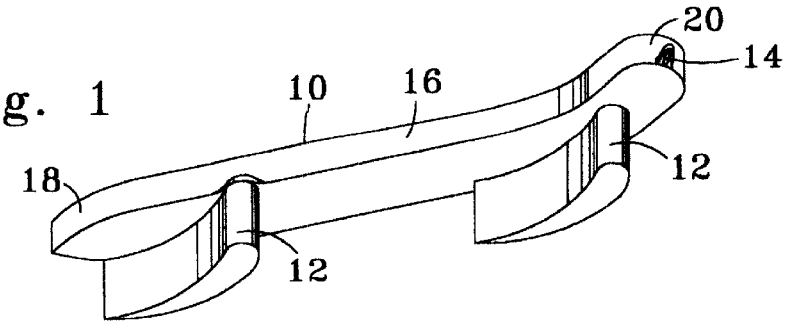
FIG. 1 illustrates an elevation view of a float integrated with two diverter vanes.

The invention provides an improved apparatus for towing marine seismic cables. An improved float provides buoyancy for a marine divertor while minimizing drag as the diverter is towed through water. FIG. 1 illustrates one embodiment of the invention wherein float 10 is attached to diverter vanes 12. Float 10 has clasp 14 for attachment to a cable (not shown) and includes mid section 16, tapered trailing end 18, and curved leading end 20. Float 10 comprises a hollow body or cellular material having a density less than water 22. Vanes 12 are wing shaped to provide a motive force in a selected direction as vanes 12 are towed through water 22.

Figure 2:
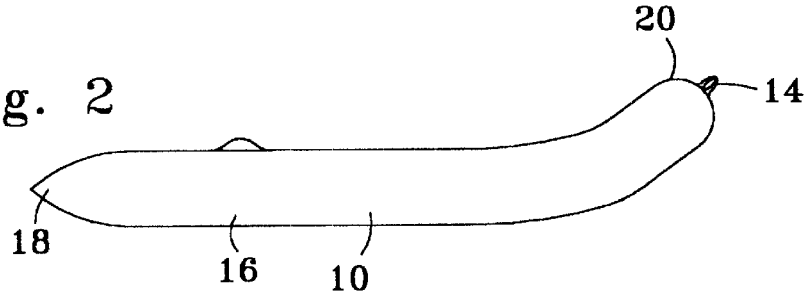
FIG. 2 illustrates a plan view of a float having a curved leading end.
Figure 3:
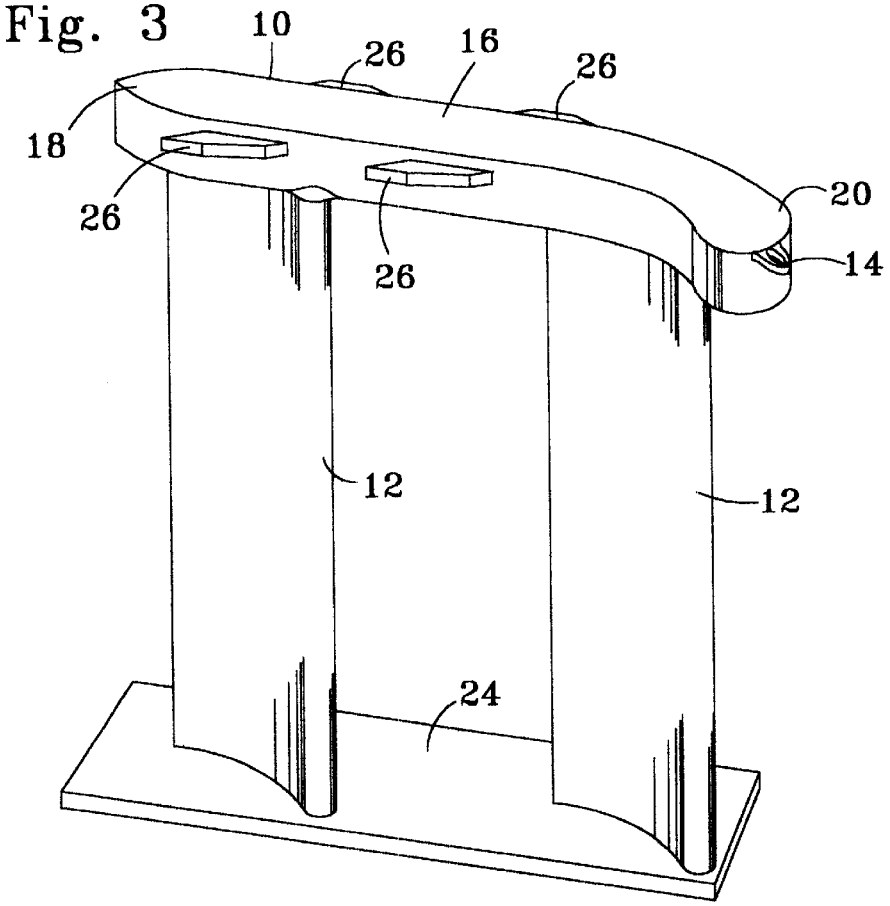
FIG. 3 illustrates an elevation view for a diverter having a float having a bulbous leading end, two vanes, and a bulkhead connected between the vanes lower ends.

A plan view of float 10 is illustrated in FIG. 2 to show the curvature of leading end 20. By pointing leading end 20 toward the tow direction, frictional drag on float 10 is significantly reduced without reducing floatation capability of float 10. Float end 10 can be bulbous as shown in FIG. 3 to enhance the lift-to-drag performance of float. As used herein the term "bulbous" can mean an enlarged configuration having a cross-section greater than that of float mid section 16. The preferred angle of leading end 20 relative to mid section 16 depends on the configuration and shape of vanes 12 and the desired tow speed and angle. In one embodiment of the invention illustrated in FIG. 2, leading end 20 is inclined at a thirty degree angle from the longitudinal axis of float mid section 16, however other inclination angles are possible and useful.

FIG. 3 also illustrates an elevation view for one embodiment of the invention wherein float 10 is attached to two vanes 12 each having a lower end connected to bulkhead plate 24. Plate 24 provides rigidity and strength to vanes 12 by resisting movement therebetween. Although float 24 is illustrated adjacent to vanes 12, chains or other devices could suspend vanes 12 from float 24 to vary the elevation of vanes 12 in the water. As shown in FIG. 3, plates, flaps or other vane foils 26 can be positioned on the outboard side of float 10 to increase overall tow efficiency.

The invention provides a curved float end pointed into the water flow direction instead of sideways to the water flow. This innovation decreases drag while providing lift to the divertor. The curved bow end and tapered stem contribute to the hydrodynamic shape of the float.

With the curved shape float described by the invention, tests demonstrated that total lift-to-drag ratio was increased by approximately ten to fifteen percent over conventional floats. As previously described, a bulbous leading end 20 further increased the lift-to-drag performance of float 10.

Instead of adding additional drag to the tow vessel, orientation of leading end 20 into the travel direction transforms float 10 into a device which not only provides buoyancy in the water but also aids in providing the transverse forces exerted by vanes 12. The combination of float 10 and one or more vanes 12 provides a divertor system not previously known, and provides new functions and benefits not provided by conventional floats or divertors. Among other benefits, the invention permits separation or integration of float 10 relative to vanes 12. The invention actually decreases the total drag acting on a divertor, thereby permitting marine crews to add more cables and other equipment to the marine seismic array before the tow vessel is overpowered by drag from the towed equipment.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for providing floatation to a marine divertor in water, comprising:

a hollow body attached to the divertor for providing positive buoyancy to said divertor when said divertor is moved through the water; and a curved leading end of said body substantially oriented at a lateral angle facing the direction of said divertor movement through the water.

2. An apparatus as recited in claim 1, wherein said angle of said leading body end is selected to reduce drag induced by the water as said body and the divertor are moved through the water.

3. An apparatus as recited in claim 1, wherein said body has an inboard side and an outboard side, and wherein said angle of said leading body end leads toward said body outboard side.

4. An apparatus as recited in claim 1, wherein said curved leading end is bulbous in shape.

5. An apparatus as recited in claim 1, wherein said body has a tapered trailing end.

6. An apparatus as recited in claim 1, wherein said hollow body is integrated with the divertor.

7. An apparatus as recited in claim 1, wherein said float has an outboard side, and further comprising at least one vane foil attached to said float outboard side.

8. An apparatus for urging a tow cable transverse to the travel direction of a tow vessel in water; comprising:

a body attached to the tow cable;

a divertor vane attached to said body for urging said body and attached tow cable at an angle transverse to the tow vessel travel direction; and a float attached to said body for providing positive buoyancy to said body when said body is moved through the water, wherein said float includes a curved leading end substantially oriented at a lateral angle facing the direction of said divertor movement through the water.

9. An apparatus as recited in claim 8, wherein said leading float end is oriented at an angle relative to said body so that said leading float end faces the tow vessel travel direction.

10. An apparatus as recited in claim 8, wherein said body has an inboard side and an outboard side, and wherein said angle of said leading float end leads toward said body outboard side.

11. An apparatus as recited in claim 8, wherein said leading float end is bulbous in shape.

12. An apparatus as recited in claim 8, wherein said float has a tapered trailing end.

13. An apparatus as recited in claim 10, further comprising at least one vane foil attached to said float on said body outboard side.

14. An apparatus as recited in claim 8, further comprising two diverter vanes having upper ends attached to said float.

15. An apparatus as recited in claim 8, wherein said leading end of said float faces the same direction as a leading edge of said diverter vane.

16. A tow system for moving seismic equipment through water, comprising:

a tow vessel moveable in a selected travel direction through the water;

a cable attached to the tow vessel and to the seismic equipment;

a body attached to said cable;

a divertor vane attached to said body for urging said body and attached cable at an angle transverse to said tow vessel travel direction; and a float attached to said body for providing positive buoyancy to said body when said body is moved through the water, wherein said float includes a curved leading end substantially oriented at a lateral angle facing the direction of said divertor movement though the water.

17. An apparatus as recited in claim 16, wherein said leading body end is substantially oriented at an angle facing the direction of said tow vessel travel direction.

18. An apparatus as recited in claim 17, wherein said angle of said leading body end is selected to reduce drag induced by the water as said body and said divertor vane are moved through the water.

19. An apparatus as recited in claim 17, wherein said body has an inboard side and an outboard side, and wherein said angle of said leading body end leads toward said body outboard side.

20. An apparatus for providing floatation to a marine divertor in water, comprising:

a hollow body attached to the divertor for providing positive buoyancy to said divertor when said divertor is moved through the water, the hollow body including a curved leading end substantially oriented at an angle facing the direction of said divertor movement through the water;

a plurality of vanes extending from the hollow body; and a plate to which the vanes are affixed at an end distal to the hollow body.

21. An apparatus as recited in claim 20, wherein said angle of said leading body end is selected to reduce drag induced by the water as said body and the divertor are moved through the water.

22. An apparatus as recited in claim 20, wherein said body has an inboard side and an outboard side, and wherein said angle of said leading body end leads toward said body outboard side.

23. An apparatus as recited in claim 20, wherein said curved leading end is bulbous in shape.

24. An apparatus as recited in claim 20, wherein said body has a tapered trailing end.

25. An apparatus as recited in claim 20, wherein said hollow body is integrated with the divertor.

26. An apparatus as recited in claim 20, wherein said float has an outboard side, and further comprising at least one vane foil attached to said float outboard side.

* * * * *